US009115566B2

(12) United States Patent
Amudo

(10) Patent No.: US 9,115,566 B2
(45) Date of Patent: Aug. 25, 2015

(54) SYSTEM AND METHOD FOR HYDROCARBON PRODUCTION FORECASTING

(75) Inventor: Chidi Amudo, Perth (AU)

(73) Assignee: Chevron U.S.A. Inc., San Ramon, CA (US)

( * ) Notice: Subject to any disclaimer, the term of this patent is extended or adjusted under 35 U.S.C. 154(b) by 556 days.

(21) Appl. No.: 13/534,025

(22) Filed: Jun. 27, 2012

(65) Prior Publication Data

US 2012/0330634 A1 Dec. 27, 2012

Related U.S. Application Data

(60) Provisional application No. 61/501,628, filed on Jun. 27, 2011.

(51) Int. Cl.
*G06G 7/48* (2006.01)
*E21B 43/00* (2006.01)

(52) U.S. Cl.
CPC ..... *E21B 43/00* (2013.01)

(58) Field of Classification Search
USPC ..... 703/10
See application file for complete search history.

(56) References Cited

U.S. PATENT DOCUMENTS

2003/0038734 A1* 2/2003 Hirsch et al. ..... 340/853.1
2007/0297858 A1* 12/2007 Imbrie ..... 405/128.45

* cited by examiner

*Primary Examiner* — Saif Alhija
(74) *Attorney, Agent, or Firm* — Marie L. Clapp

(57) ABSTRACT

A system and method for hydrocarbon production forecasting which includes creating an integrated production model representative of at least two interconnected subsurface tanks, at least one well, and a surface network, wherein the surface network comprises multiple components including at least one pipeline; parameterizing a subsurface part of the integrated production model by using material balance to characterize the at least two interconnected subsurface tanks; parameterizing a well part of the integrated production model based in part on well geometry; parameterizing the surface network based on the multiple components of the surface network; combining the parameterized subsurface part, the parameterized well part and the parameterized surface network into an improved integrated production model; forecasting hydrocarbon production based on the improved integrated production model and displaying the input, output and intermediary products.

18 Claims, 12 Drawing Sheets

SYSTEM AND METHOD FOR HYDROCARBON PRODUCTION FORECASTING

CROSS REFERENCE TO RELATED APPLICATIONS

This application claims priority to U.S. Patent Application Ser. No. 61/501,628 with a filing date of Jun. 27, 2011.

FIELD OF THE INVENTION

The present invention relates generally to methods and systems for hydrocarbon production forecasting and, in particular, methods and systems for creating an integrated production model for hydrocarbon production forecasting.

BACKGROUND OF THE INVENTION

Production forecasting involves attaching a timescale to production recovery and it is one of the most vital roles of reservoir engineering. It underpins the cashflow of any project and can make the difference between a project being sanctioned or abandoned. The complexity of the role is underscored by the requirement to integrate multiple and diverse disciplines including subsurface characterisation, surface network configuration, production philosophy, economic limits, business decisions and operational constraints.

Unlike production forecasting for oil fields, gas forecasting is further complicated by long-term contracts and the need to meet contractual obligations. This requirement means that gas companies need to correctly predict the execution of future projects to ensure that they have enough gas security to satisfy their contractual obligations. Usually, in gas forecasting, multiple fields with diverse fluid properties are produced simultaneously and this further introduces the complication of gas quality and maximizing the value of by-products like condensate and natural gas liquids. These complexities imply that an integrated gas forecasting model is required to accurately predict production for a gas field. There are many such products available including company proprietary software for internal use only and commercial software in the public domain. One such commercial product is the Integrated Production Model (IPM) suite of software by Petroleum Experts (PETEX).

The following industry standard acronyms are used in this paper:

BBL=Barrel
BHP=Bottom Hole Pressure
dP=Pressure Drop
$F_w$=Water fractional flow
GAP=General Allocation Package—IPM Software
GOR=Gas Oil Ratio
IAM=Integrated Asset Management
IPM=Integrated Production Model
IPR=Inflow Performance Relationship
LNG=Liquefied natural gas
LPG=Liquefied Petroleum Gas
MBAL=Material Balance—IPM Software
MCP=Major Capital Project
MMSCF=Million Standard Cubic Feet
NOJV=Non-Operated Joint Venture
NPV=Net Present Value
PETEX=Petroleum Experts
PV=Pore Volume
PVT=Pressure Volume Temperature
QC=Quality Control SCAL=Special Core Analysis
Tmax=Technical Max
VBA=Visual Basic for Applications
VLP=Vertical Lift Performance
WGR=Water Gas Ratio

SUMMARY OF THE INVENTION

According to one implementation of the present invention, a computer-implemented method for characterizing a subsurface reservoir is presented. An embodiment of the invention includes creating an integrated production model representative of at least two interconnected subsurface tanks, at least one well, and a surface network, wherein the surface network comprises multiple components including at least one pipeline; parameterizing a subsurface part of the integrated production model by using material balance to characterize the at least two interconnected subsurface tanks; parameterizing a well part of the integrated production model based in part on well geometry; parameterizing the surface network based on the multiple components of the surface network; combining the parameterized subsurface part, the parameterized well part and the parameterized surface network into an improved integrated production model; and forecasting hydrocarbon production based on the improved integrated production model.

Another embodiment of the invention includes a computer system configured to implement executable computer modules designed to perform the steps of the method described above and to display the input, output and intermediary products of the method.

The above summary section is provided to introduce a selection of concepts in a simplified form that are further described below in the detailed description section. The summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

These and other features of the present invention will become better understood with regard to the following description, claims and accompanying drawings where:

DETAILED DESCRIPTION OF THE INVENTION

Figure 1:
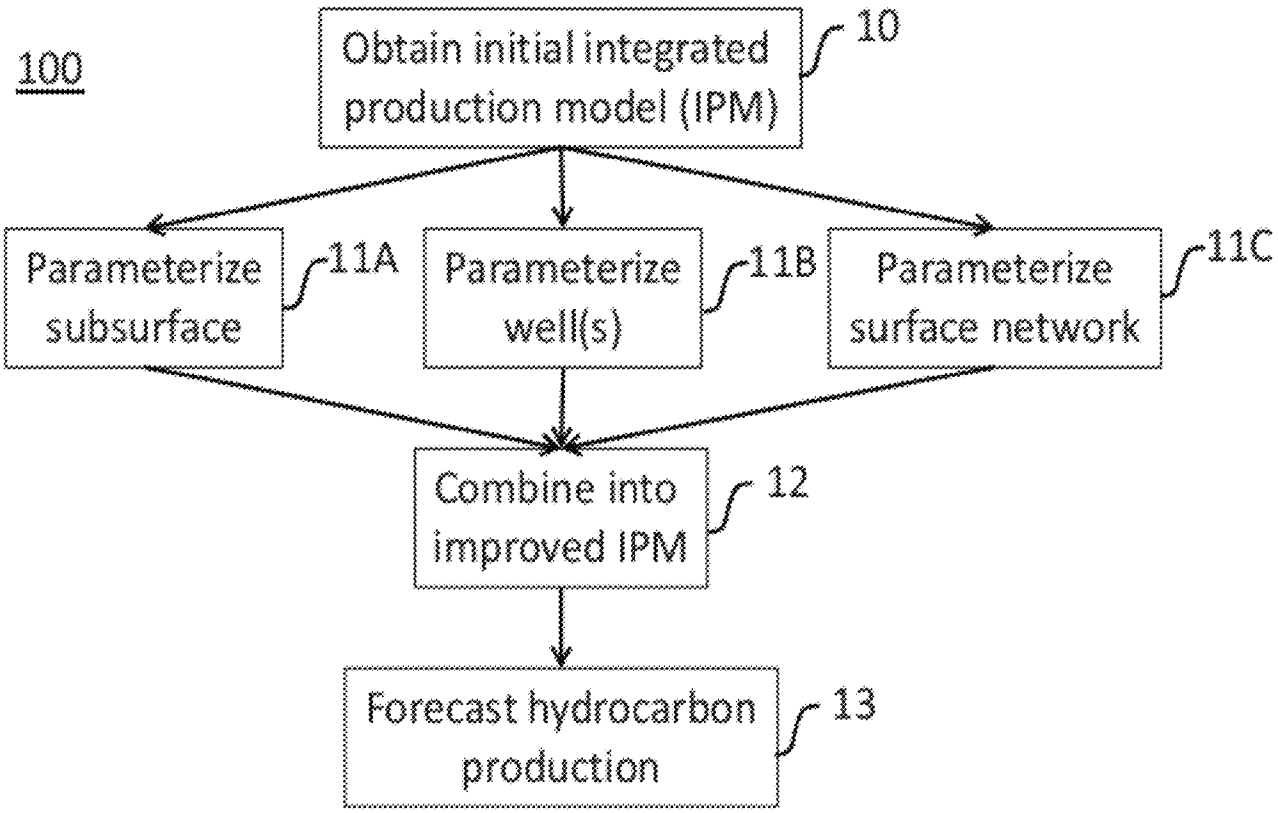
FIG. 1 is a schematic of the IPM of the present invention.

The present invention may be described and implemented in the general context of a system and computer methods to be executed by a computer. Such computer-executable instructions may include programs, routines, objects, components, data structures, and computer software technologies that can be used to perform particular tasks and process abstract data types. Software implementations of the present invention may be coded in different languages for application in a variety of computing platforms and environments. It will be appreciated that the scope and underlying principles of the present invention are not limited to any particular computer software technology.

Moreover, those skilled in the art will appreciate that the present invention may be practiced using any one or combination of hardware and software configurations, including but not limited to a system having single and/or multiple processor computers, hand-held devices, programmable consumer electronics, mini-computers, mainframe computers, and the like. The invention may also be practiced in distributed computing environments where tasks are performed by servers or other processing devices that are linked through a one or more data communications network. In a distributed computing environment, program modules may be located in both local and remote computer storage media including memory storage devices. The present invention may also be practiced as part of a down-hole sensor or measuring device or as part of a laboratory measuring device.

Also, an article of manufacture for use with a computer processor, such as a CD, pre-recorded disk or other equivalent devices, may include a computer program storage medium and program means recorded thereon for directing the computer processor to facilitate the implementation and practice of the present invention. Such devices and articles of manufacture also fall within the spirit and scope of the present invention.

Referring now to the drawings, embodiments of the present invention will be described. The invention can be implemented in numerous ways, including, for example, as a system (including a computer processing system), a method (including a computer implemented method), an apparatus, a computer readable medium, a computer program product, a graphical user interface, a web portal, or a data structure tangibly fixed in a computer readable memory. Several embodiments of the present invention are discussed below. The appended drawings illustrate only typical embodiments of the present invention and therefore are not to be considered limiting of its scope and breadth.

The present invention relates to hydrocarbon production forecasting and, by way of example and not limitation, hydrocarbon gas production forecasting.

FIG. 1 illustrates a flow chart of an embodiment of the invention. Method 100 begins at step 10, obtaining an initial integrated production model (IPM). This initial IPM may be generated, for example, through the use of the Integrated Production Model (IPM) suite of software by Petroleum Experts (PETEX). Alternatively, it may be built by other software packages capable of representing a complete IPM. The initial IPM may also be the result of a previous implementation of the present invention, now being updated due to changes in at least one part of the IPM. Other methods of generating the initial IPM are possible and the previous examples are not meant to be limiting. Any IPM from any source may be used as an initial IPM for this method.

Figure 2:
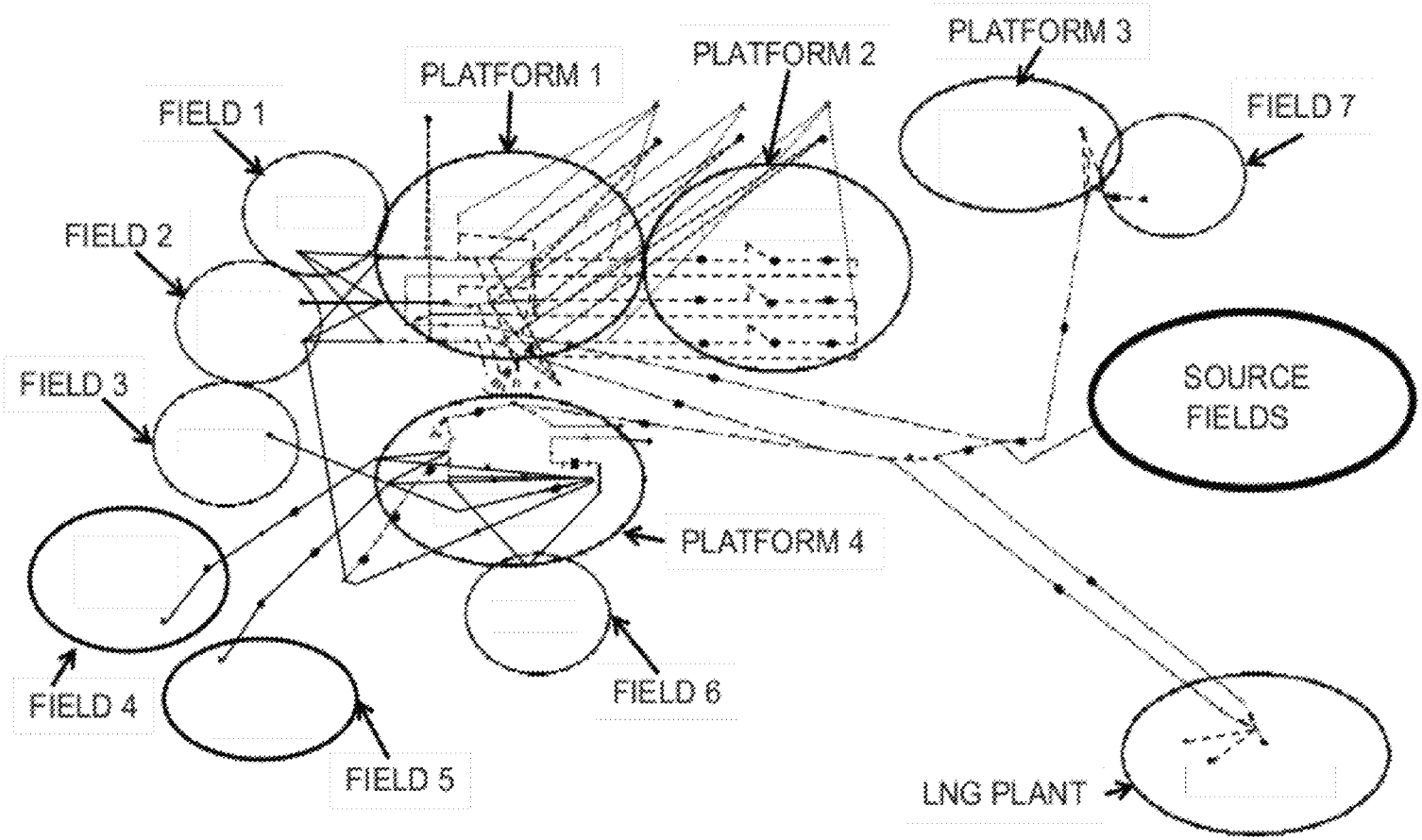
FIG. 2 is a flowchart illustrating a method in accordance with another embodiment of the present invention.
Figure 3:
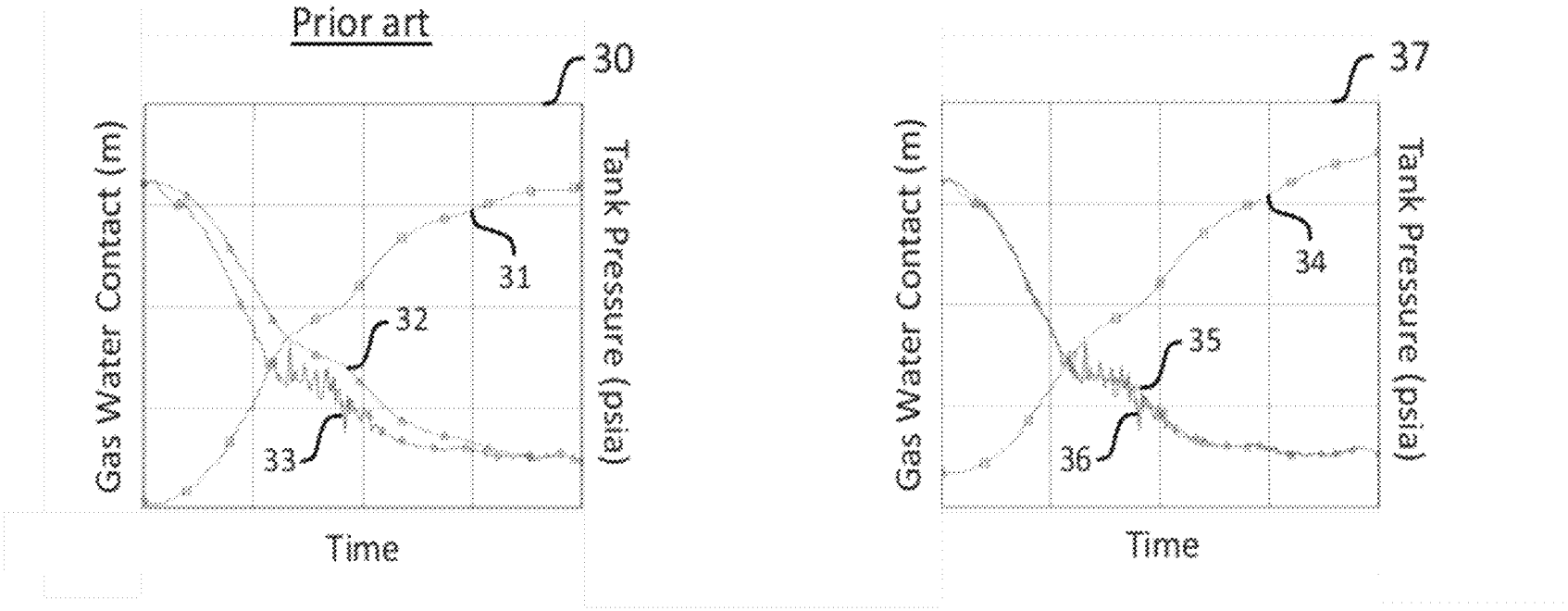
FIG. 3 is a comparison of pressure matching using a prior art IPM and the IPM of the present invention.

FIG. 2 presents an exemplary schematic of an IPM. The model starts at the fields, labelled as Fields 1-7 and Source Fields, which include subsurface tanks and wells, and terminates at the slug catcher of the onshore plant labelled LNG Plant. Each of the fields in the model is represented by one or more tanks depending on the complexity required to achieve an accurate representation of the sub-surface characterization. All the critical surface facilities are appropriately modelled. For example, all the existing and proposed topside processing facilities (Platforms 1-4, LNG Plant), compressors, flowlines and trunklines are captured in the model.

With a multi-disciplinary team working together on an integrated model, it is useful to assign different parts of the model to different team members. For example, individual reservoir (petroleum) engineers update the reservoir characterization, fluid properties and well models for their assigned fields; and facilities engineers ensure that the platforms, compression facilities and remaining surface network are up to date with the latest field data and operational constraints. This concept is valuable when assigning key responsibilities within a team. The difficulty lies in understanding how to incorporate each engineer's updates into the model.

To reduce this problem, flowsheets are used to break up the model into "standalone" sub-models. The engineer responsible makes changes only in their assigned area and exports changes to a partial-IPM. This partial IPM is then imported by an overall IPM-custodian during each major model update. In this way, the custodian is responsible for developing forecasts while the field engineers are responsible for all their parts of the model. This has enhanced the ability of the overall IPM-custodian to debug the model and has facilitated the process of model endorsement by all stakeholders.

Referring again to FIG. 1, once the initial IPM is obtained, the subsurface part of the IPM is parameterized at step 11A. The use of material balance (done, for example, via the PETEX program MBAL) to describe the sub-surface characterization of the very diverse reservoir systems that make up the asset, allows the model to keep things simple in explaining the essential features of a reservoir system. However, this simplicity comes with its limitations. One of the characteristics of a MBAL tank model is the rapid transmission of pressure changes throughout the system which enables it to be treated as zero dimensional. This transmission is determined in large part by the hydraulic diffusivity constant, $k/\emptyset\mu c$. The higher this parametric group, the more rapidly pressure equilibrium is achieved and the more applicable MBAL becomes. So, while it may be geologically sound to use a single tank to represent an excellently connected gas reservoir with multi-darcy permeability, low viscosity and high compressibility; the reality is that as the reservoir volume increases the capacity to rapidly transmit pressure throughout the reservoir deteriorates. A related limitation of an MBAL tank is that it generally determines water production from the properties of the tank. Consequently, drainage points with observed differences in their fractional flow curves may be assigned the same fractional flow curve in MBAL for predictions. This diminishes the capacity of the model to monitor or predict water production in aquifer-drive reservoirs. The following examples will serve to illustrate each of these limitations and how they have been addressed in the model.

Error! Reference source not found. is an example of an initial poor pressure match 30 for a reservoir tank due to the limitation of MBAL which assumes instantaneous pressure transmission within a reservoir despite the reservoir size, labelled as prior art. This particular example has about 2 Tcf of gas in-place with only one drainage point. Line 33 shows the historical pressure data, line 32 shows the simulated pressure data from the prior art model, and line 31 shows the simulated gas water contact. Note the poor match between line 33 and line 32. The solution to improve the history match relies on being able to introduce some pressure transient within the reservoir. At step 11A of the present embodiment, the pressure match 37 is significantly improved by dividing the tank into two connected tanks. Here, line 36 shows the historical pressure data, line 35 shows the simulated pressure data from the IPM of the present invention, and line 34 shows the simulated gas water contact. The match between line 36 and line 35 is much improved. Step 11A of method 100 uses the transmissibility factor between the tanks as a history match tuning parameter. This configuration retains the interconnectivity of the overall reservoir system and, more importantly, allows the development of a pressure gradient across the reservoir as expected in a tank of this size.

Prior art methods have modelled water production by monitoring fluid contacts, for example by entering pore volume (PV) versus depth (D) data, relative permeability curves and linking the tanks to the well models. This may be done, for example, by using the industry standard software MBAL, SCAL, PROSPER and GAP. This fairly obvious approach is inadequate because of two problems: fluid contacts within MBAL are not used for the calculation of fluid production unless MBAL is specifically set up to do so and the relative permeability input to a single cell material balance model is not the same as relative permeability on a core plug scale. Also, the MBAL relative permeability needs to account for the well location, perforation depth and reservoir heterogeneity. In order to appropriately model water production, it is necessary to parameterize the well part of the IPM, shown in FIG. 1 as step 11B.

As explained earlier, the default setting in MBAL is that a well uses the relative permeability of the tank to which it is connected. This implies that all the wells connected to the same tank will, by default, produce the same proportion of each fluid phase regardless of differences in well location and reservoir properties. To account for the difference in water production between wells, the present embodiment employs two different approaches depending on the well geometry.

For horizontal wells, the present embodiment overrides the default method of calculating water production from MBAL and links the water production directly to the contact movement. In an aquifer drive gas reservoir system, the flood front is unconditionally stable because the very low gas viscosity ensures that the end-point mobility ratio for water displacing gas is so low that it dominates the influences of heterogeneity and gravity. In this scenario there is little water production until the contact reaches the perforations at which point the water production increases exponentially until the wells fail due to liquid loading. This is modelled by enabling the monitor contacts option in MBAL and defining an abandonment contact depth for each well based on the perforation depths. In GAP, the implementation has an identical intent but its implementation is slightly more complicated because GAP does not have the ability to abandon wells based on the contact depth. To overcome this problem, a water breakthrough depth is defined for each well at the perforation depth, the 'Shift Rel Perm to Breakthrough' option is set to 'No', and the abandonment constraint is set to a low water-gas ratio (WGR) slightly higher than the condensation WGR. In one embodiment, 5 bbl/MMscf was determined to be adequate but this is not intended to be limiting. This set up prevents the production of free water until the contact reaches the perforation depth. When this occurs there is a step change in free water production that triggers the abandonment WGR constraint and shuts in the well.

Figure 4:
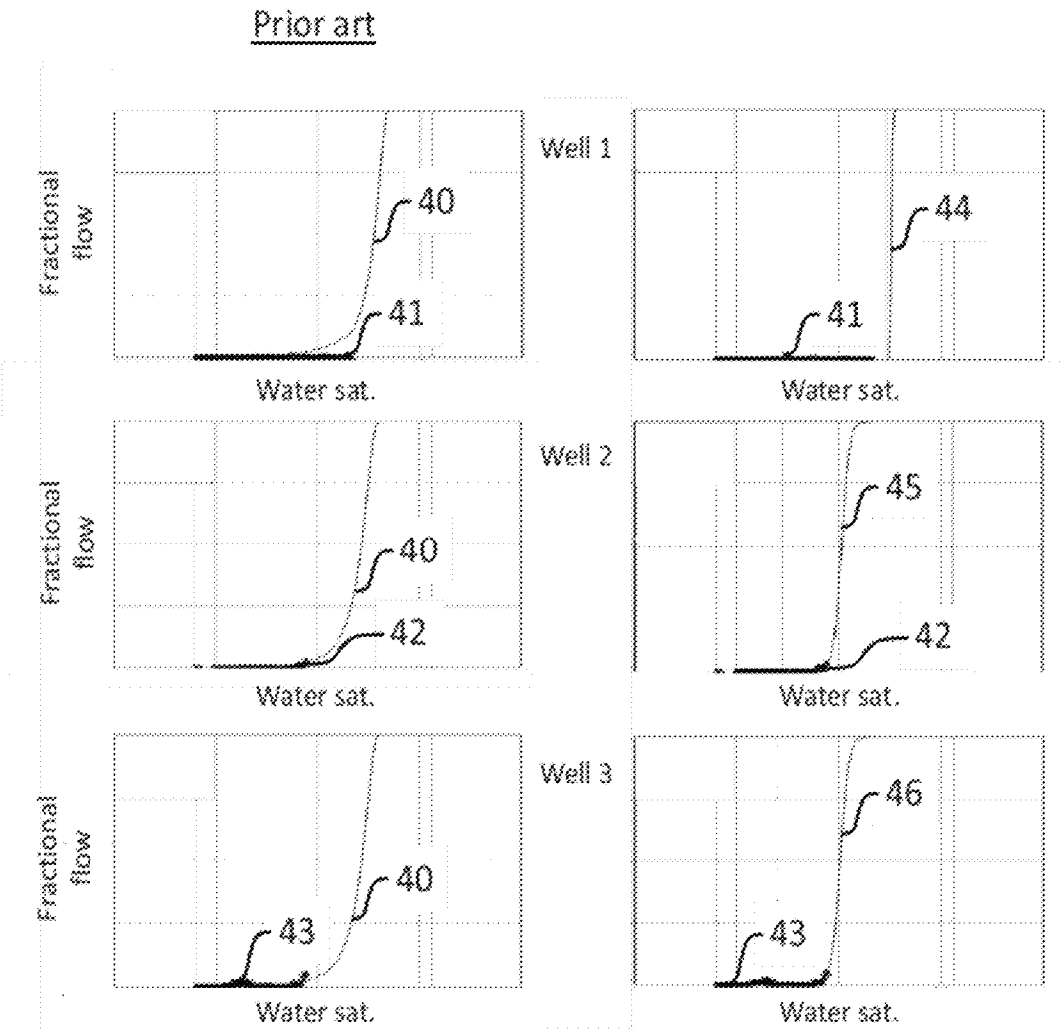
FIG. 4 is a comparison of water production matching using a prior art IPM and the IPM of the present invention.
Figure 5:
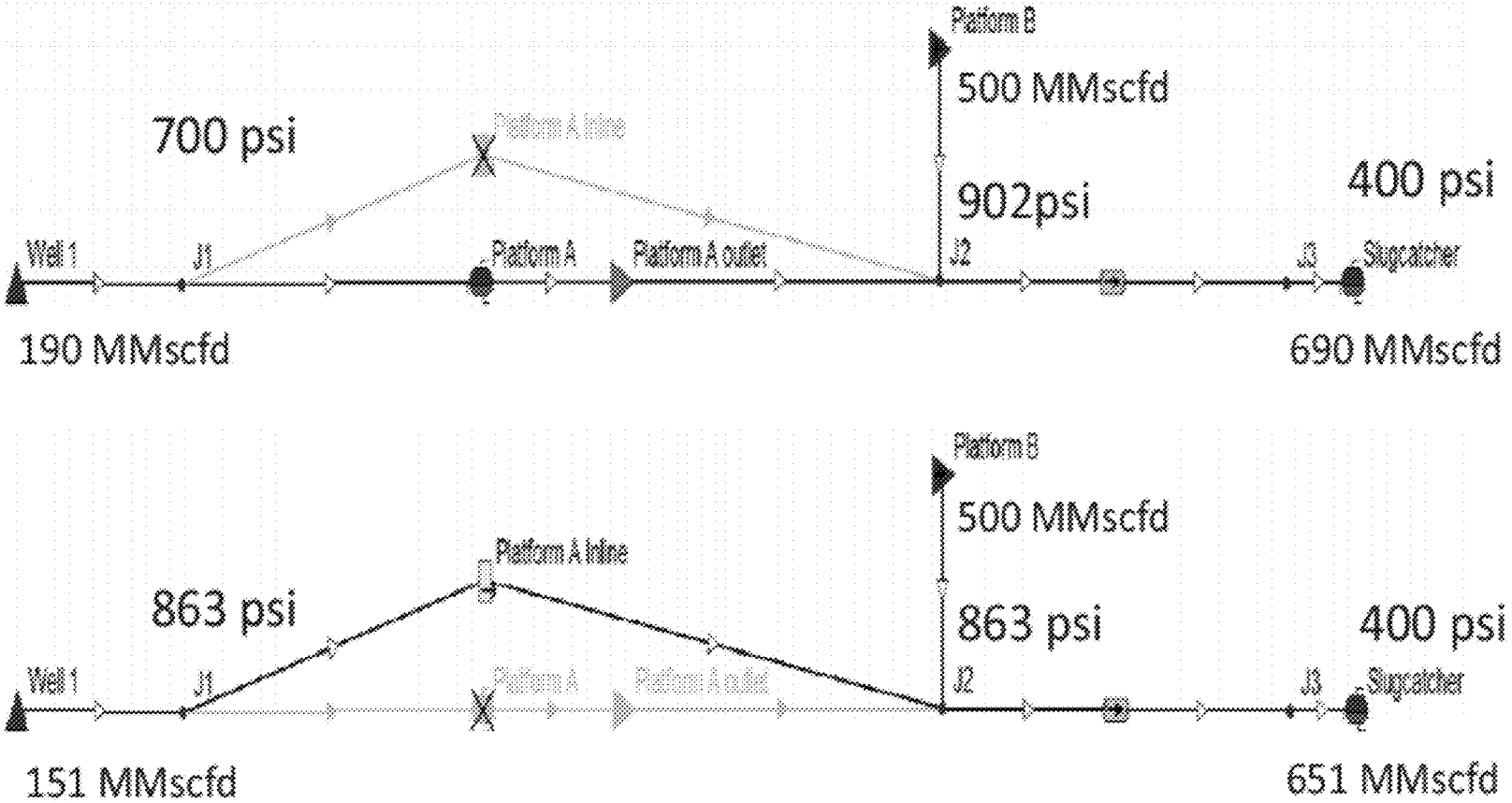
FIG. 5 demonstrates two types of separators that may be incorporated in the IPM.
Figure 6:
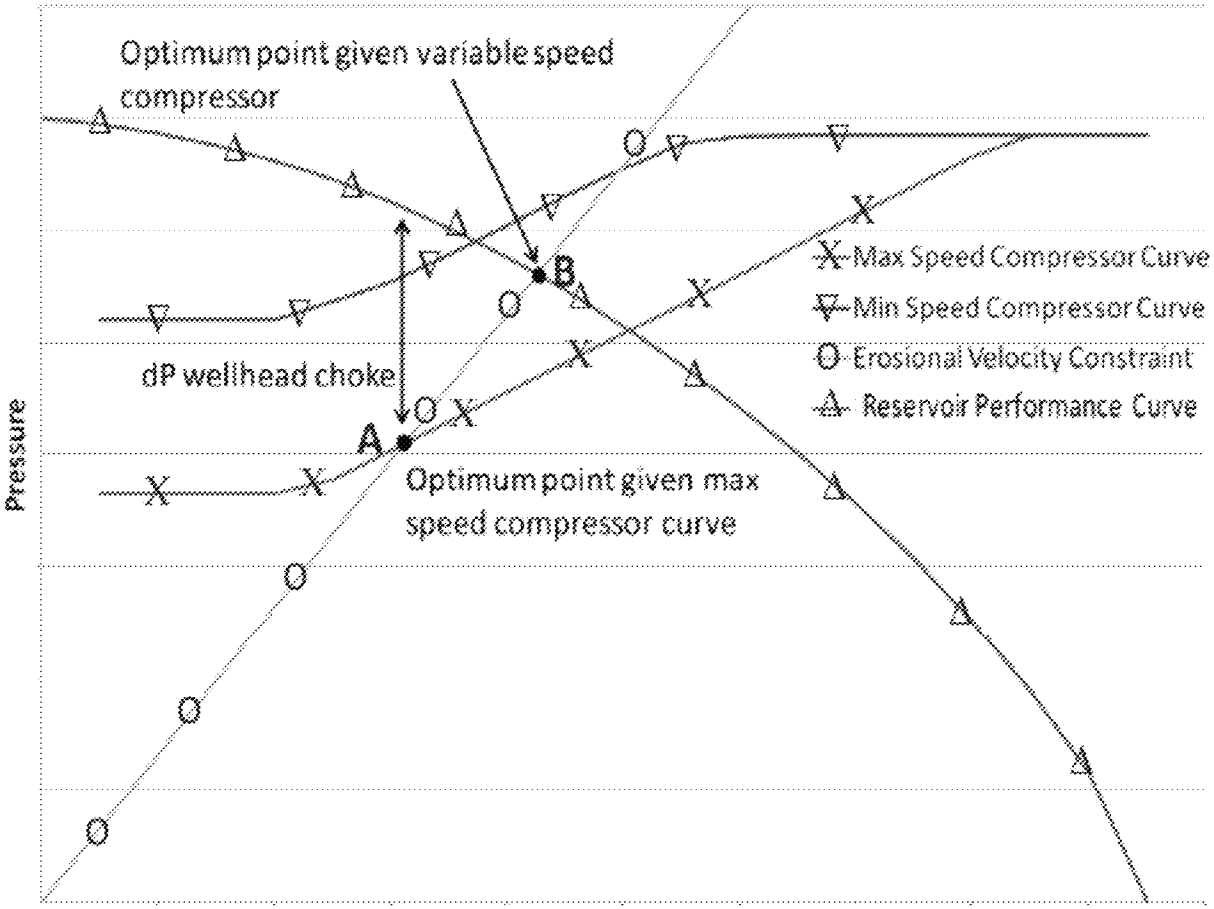
FIG. 6 graphically displays curves used to model compressors in the IPM of the present invention.

The second approach is used for the case where there is a gradual increase in water production with time, which is usually the situation with vertical or deviated wells. This approach depends on having free water production data per well that are either measured or derived from a representative reservoir simulation model. The first step is to generate individual fractional flow curves for each well by using the 'Fw Matching' option and regressing against the actual (or simulated) water production. If there is no historical (or simulated) free water production from a well, then a fractional flow curve from an analogous well with water production can be utilized. The fractional flow curve is copied from the analogous well to the well without water production and then the breakthrough saturation is modified to delay the onset of water production, with an estimate of the breakthrough saturation being made on the basis of the well location and data from other wells in the field. Error! Reference source not found. shows a markedly improved water production match when using individual fractional flow curve per well instead of the default MBAL approach of assigning the same fractional flow curve to all wells in the same tank. In FIG. 4, the input data from 3 wells is seen as line 41, line 42, and line 43 in both the prior art case on the left and the present embodiment on the right. The prior art uses the same fractional flow curve 40 for all wells while the present embodiment uses individual curves 44, 45, and 46. The present embodiment matches the historical data much better. This fractional flow information is stored in the history wells in MBAL as relative permeability curves. For forecasting purposes, it is necessary to copy the data from the MBAL history wells to either the MBAL prediction wells or the GAP wells (depending on the tool used for prediction). This is usually a manual exercise but there is functionality in GAP that allows relative permeability curves to be copied from MBAL wells to wells in GAP.

In addition to GAP and MBAL, it is possible to use PROSPER as part of step 11B of method 100. PROSPER is the part of the Integrated Production Modelling toolkit that handles well performance, design and optimization. It is designed to allow the construction of reliable and consistent well models and has the capability to incorporate each aspect of the well bore modelling including fluid characterization (PVT), inflow performance relationship (IPR) and pressure losses along tubing and flowlines (VLP). However, there are multiple challenges in using PROSPER especially for modelling big bore or high rate wells that are capable of producing in excess of 300 MMscf/d. These problems include a lack of well test data because of limitations in the size of the test separators available on the platforms, location of permanent downhole gauges relatively high above the perforations resulting in extrapolation errors in bottom hole pressures (BHP), possibility of the VLP-predicted BHP to be higher than the reservoir pressure resulting in a non-physical situation an apparent lack of transparency in ensuring consistency in the well models between the different software (PROSPER, MBAL and GAP). These difficulties will be addressed when step 12 of method 100 is described.

At step 11C of method 100, the surface network is parameterized. This may be done, for example, using GAP. GAP may also be used to integrate the subsurface and wells with the surface (pipelines, separators and compressors) elements. Due to the level of integration in GAP, decisions in one area of the model can have implications on other areas. One example of this is in modelling intermediate separators within a GAP model. Modelling these as inline separators rather than fixed pressure separators increases the flexibility to appropriately respond to future changes in conditions anywhere in the model. However, modelling separators as inline itself has flow on effects to other areas of the model, particularly the calibration of pipelines. Proper calibration is much more important with upstream inline separators than it is with fixed pressure separators. Another area where the interdependency between model elements (including wells and pipeline constraints) can cause problems is in modelling compressors. The following examples will illustrate these issues.

There are two types of separator models available in GAP—fixed pressure and inline (floating) separators. Fixed pressure separators allow pressure discontinuities between the separator inlet and the outlet streams. To avoid non-physical situations where production flows from a lower inlet pressure node to a higher outlet pressure node, fixed separators should be used only at the boundary of a network system. Unfortunately, prior art methods use fixed separators within the production network to minimize observed convergence problems and reduce the simulation run time. A further quality check (QC) was usually performed to ensure that there was no non-physical flow from a low to a high pressure point in the system. However, with staff turnover this important QC step is easily ignored and can result in serious violations at some of the fixed separator nodes.

Error! Reference source not found. shows a hypothetical example with a single well (Well 1) producing to Platform A via a separator and commingled downstream with a source producer (Platform B). The combined production from Platform A and Platform B then flows through a 200 km 32" pipeline to a slugcatcher. This system was solved for both the fixed pressure (700 psia separator pressure), shown in the top diagram, and inline separator, shown in the bottom diagram, cases, with the resulting pressures at each node shown as psi and the gas flowrate for each element shown as MMscfd along the paths of the pipeline. In this example, the fixed separator case shows a pressure discontinuity at Platform A (an unphysical increase from 700 psia to 902 psia) while the inline separator has no pressure discontinuity. The impact of correctly modelling the pipeline network is a reduction in production from Well 1 because the back pressure is higher than in the fixed pressure separator model. This hypothetical example mimics part of the model. For example, if Platform B was originally expected to produce 200 MMscf/d then the pressure immediately downstream of Platform A would have been 620 psi and an initial review by the project team would not have noticed any pressure discontinuity. However, with additional drilling on Platform B, the production increased to about 500 MMscf/d resulting in a pressure discontinuity in the fixed pressure separator scenario. If these changes coincided with staff turnover, the new staff may not have been aware of the need to investigate potential pressure discontinuities in the system. To avoid this problem, the IPM of the present embodiment now has only inline separators within the network and one fixed pressure node at the boundary of the production system.

In addition to separators, the surface network may include compressors. The modelling options for a compressor in the GAP model include using fixed pressure drop (dP), fixed power, reciprocating and performance curve models. Conventional methods modelled compressors using the performance curve option defined at their maximum speed. This effectively makes the compressors uncontrollable in the optimization routine. A major limitation of this approach is that the solution produced by a maximum speed compressor may not be optimum as illustrated by Point A in Error! Reference source not found. In this example, presence of velocity constraints and controllable wells upstream of compressors caused difficulty with the network solver. Choking back wells in response to the constraint to reduce the velocity through the compressor also reduces the inlet pressure. The reduction in the inlet pressure causes an increase in the fluid velocity which may potentially violate the flowline velocity constraint. This loop would be repeated several times until either the optimiser finds a solution that meets all the constraints or until it is unable to find a solution that meets all the constraints and chooses a solution that meets as many constraints as possible. The resultant effect is a suboptimal solution (see Point A in Error! Reference source not found.) where the model run time is increased, model stability is compromised, constraints are violated and production rate is reduced. The recommendation is to reduce compressor speed in preference to choking back the wells. The ideal solution is to run the compressors at a speed where the wells are not choked, yet still honour the velocity constraint envelope, shown as the Point B in Error! Reference source not found.

In this situation it is necessary to modify the compressor speed to optimise the performance of the entire system. If the wellhead chokes are also to be optimised then this requires a multi-level optimisation solution because there are a large number of combinations of wellhead chokes and compressor speeds that produce the same production rate.

Figure 7:
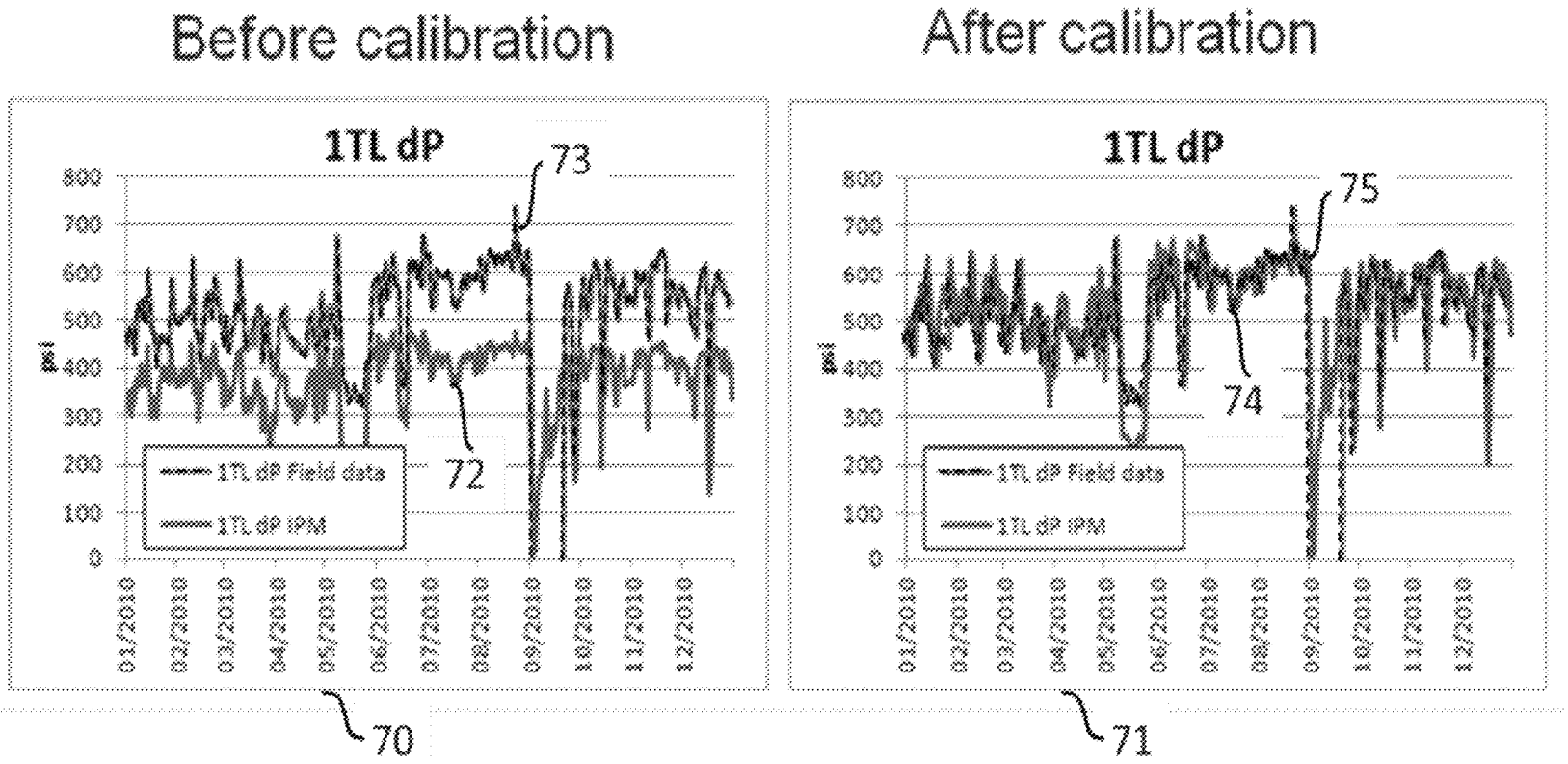
FIG. 7 illustrates calibration of the surface network part of the IPM.
Figure 8:
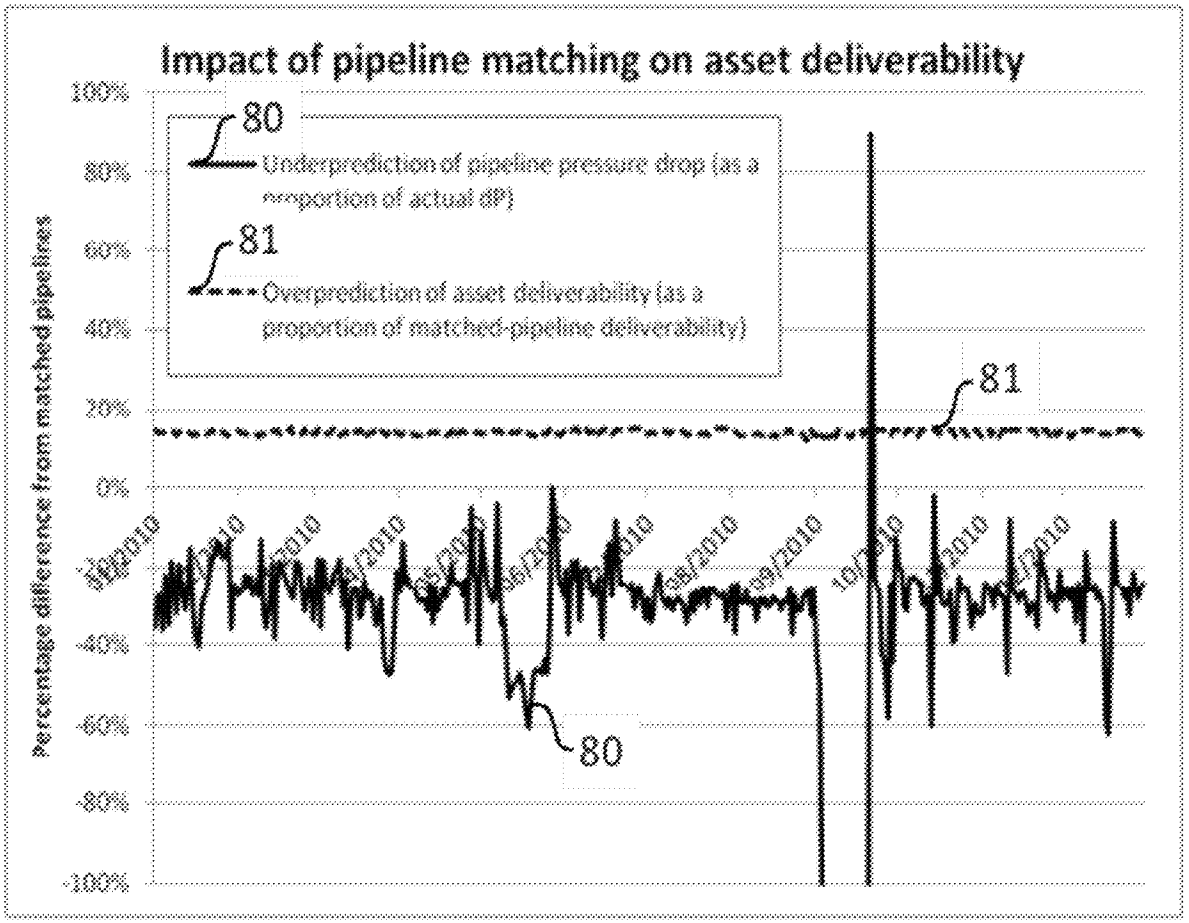
FIG. 8 illustrates the impact of poor calibration of the surface network part on production forecasting.

Just like the predictive capability of a sub-surface model is dependent on how well it is able to explain the historical performance, the forecasting capability of an integrated model is dependent on its ability to accurately model the pressure drops along the surface network. Since the fixed pressure separators within the model have been changed to inline separators, it has become possible to properly calibrate the pressure drop within the network. FIG. 7 shows the pressure match for one of the major trunklines in the surface network before calibration 70 and after calibration 71. The field data is shown as dashed lines 73 and 75, the simulated pressure drop data in the surface network is shown as lines 72 and 74. After calibration, the simulated pressure drop data for the surface network is much closer to the field data. FIG. 8 shows that a 30% underprediction in the pressure drop of one of the major trunklines (solid line 80) can lead to an 18% overprediction of the overall system gas deliverability (dashed line 81). Given the importance of the network calibration, the present embodiment uses the following steps to calibrate the surface network: retrieve daily field production data from the database; if necessary, estimate mass/volume conversion factors; load volumetric rate data as a source in GAP, using appropriate PVT per trunkline when multiple trunklines; consider the daily production for full year—ensure 0% unscheduled production deferment in GAPRun forecast and predict pressure drop in each trunkline, adjust pipe roughness until dP agrees with field data and check that the pipe roughness used in the matching is appropriate.

Step 12 of method 100 combines the subsurface part, well part and surface network part of the IPM. Difficulties arise here when trying to rectify models between the different software used for each part. For example, it is possible to parameterize the well part in both GAP and PROSPER; rectifying these is necessary to combine the well part with the surface network.

Figure 9:
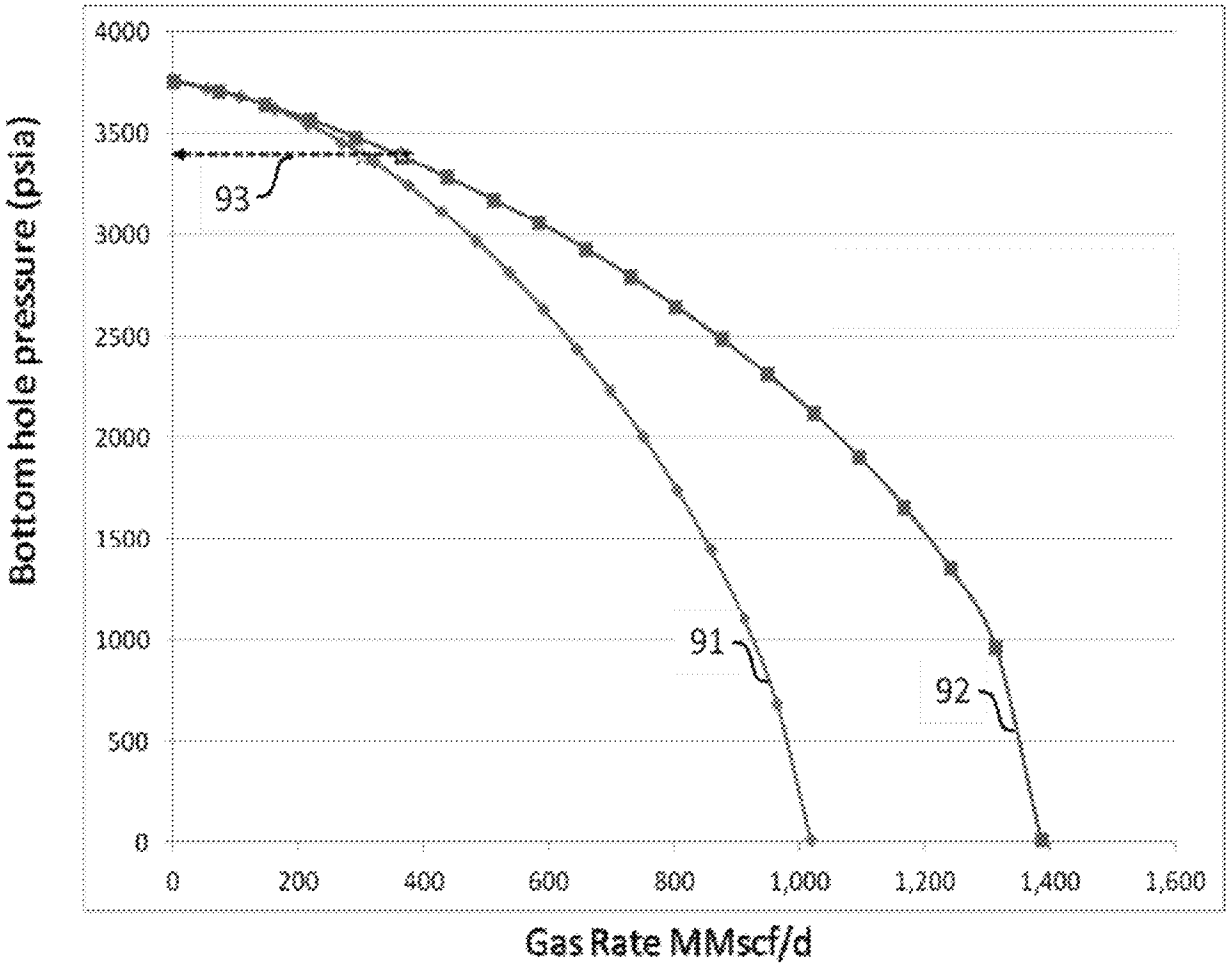
FIG. 9 illustrates discrepancies in production rates that may be used to combine parts of the IPM of the present invention.

FIG. 9 illustrates the discrepancy in production rates when a well model is not consistent between PROSPER (line 91) and GAP (line 92). In this example, the difference is as high as 40 MMscf/d at a constant 3400 psi BHP, as indicated by dashed line 93. One of the reasons for this problem is that the IPR generation method in GAP appears inappropriate for many high rate gas wells. The GAP IPR generation method selects three points on the IPR contained in PROSPER and then matches the chosen model to these three points. Unfortunately, the selected points are typically at rates less than 100 MMscfd. For wells that produce up to 360 MMscf/d, this can result in almost 20% error in the predicted gas rates. On the other hand, the IPR matching method contained in MBAL is much more appropriate because it selects a number of points from the Prosper IPR that sample the entire curve, not just the first 100 MMScfd, before fitting an IPR model. To avoid this consistency problem, the present embodiment uses an IPR model that is present in both GAP and PROSPER and manually copies the coefficients for the model to GAP and MBAL.

Step 12 of method 100 is also complicated due to human errors. This is not unexpected given the inadequate documentation of the model, staff turnover in the team and multiple people making changes to different parts of the model. The following examples illustrate this problem which range from mistakes to ignorance. During step 12, quality assurance of the model is done to ensure that these errors are identified and corrected.

It is not uncommon for engineers to rename a tank name during an update. This seemingly innocuous activity can have devastating consequence if such an update disconnects a well from a tank. If a well has a valid IPR and VLP then it will calculate a gas rate regardless of whether it is connected to a tank or not. The role the tank plays in determining the production rate from a well is in updating the well with the reservoir pressure, gas-oil ratio (GOR) and water-gas ratio (WGR). This data is stored on the IPR screen of the well. Consequently, if the well connection to the tank is broken, the well will continue to produce at a constant reservoir pressure. This results in a constant production rate from that well. During step 12 of method 100, wells should be examined to see if this behaviour occurs and be properly integrated into the model or removed.

Stream day LNG gas demand is limited by the maximum train capacity at the plant. This is the maximum daily volume of gas that the plant can process on any given day. However, there are numerous events during the year that can reduce this capacity including planned (scheduled maintenance shutdowns); unplanned (e.g. reliability) and other (e.g. weather) losses. These losses are reflected in an overall downtime value that reduces the stream day LNG demand to an annual average value. To accurately represent operating conditions and correctly capture the pressure drops in the surface network, it is recommended that separators are constrained to produce at the streamday demand rate and a downtime factor that captures all the losses is also entered into the model.

Figure 10:
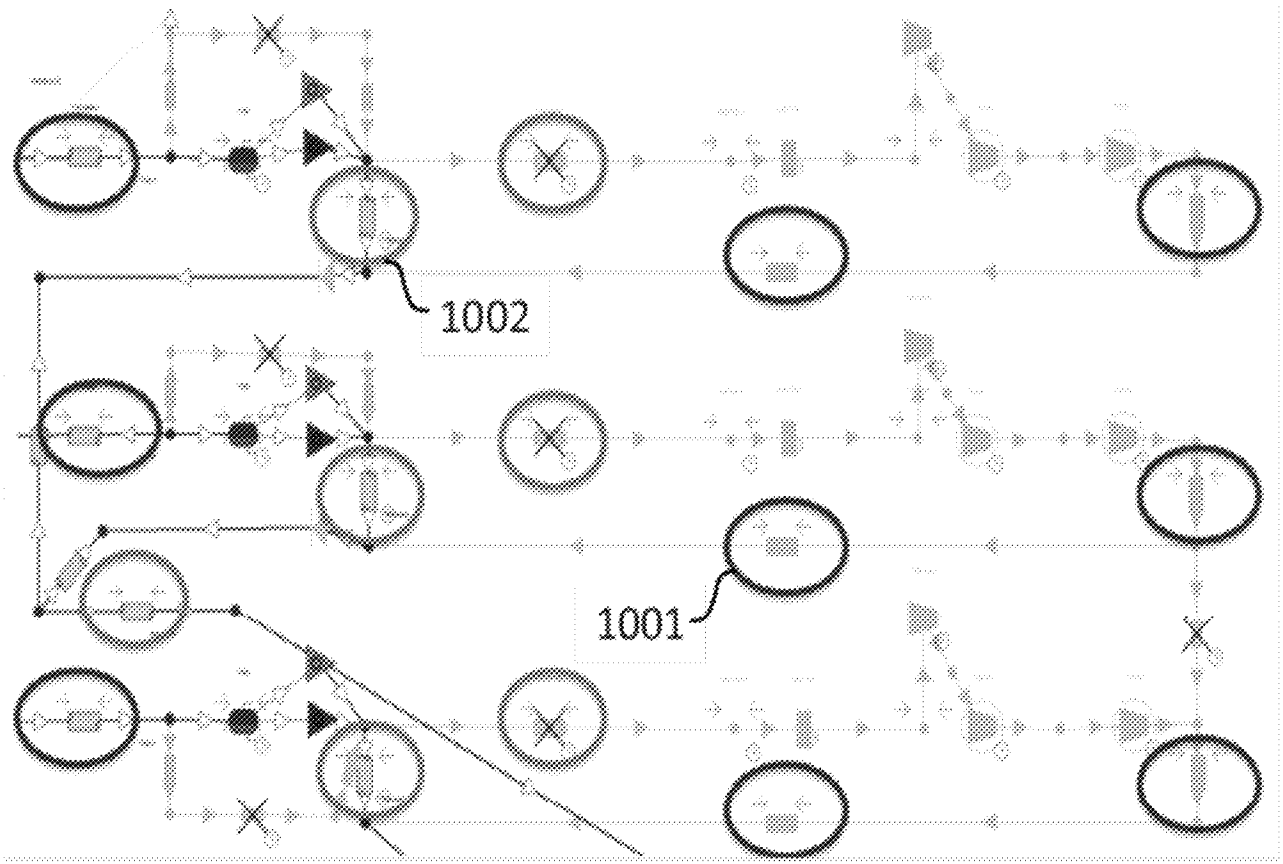
FIG. 10 illustrates a partial IPM indicating constraints.

Constraints are a key method of compelling an integrated model to meet operational limitations that affect the real asset; however inappropriate use of constraints can result in a reduction in model performance without any net benefit. A key focus when creating a model is to ensure that only constraints that can actually be violated are included, even if the total list of constraints is much larger. Unfortunately, this was not always the case in conventional methods. Conventional methods generally populated the model with every known constraint and this adversely affected the performance of the IPM Optimiser and Solver with its attendant impact on run time. The present embodiment only the necessary constraints and this has significantly improved the performance of the Optimiser and Solver. For example, FIG. 10 shows in dark circles, for example 1001, a number of velocity constraints that have been removed from the model with the necessary constraints shown in light circles, for example 1002. Examples of these redundant constraints include velocity constraints downstream of a compressor when the same constraint is present upstream of the compressor, minimum pressure constraints, velocity constraints from pipes upstream of an identical pipe with the same constraint and fluid flow rate, or any constraint that expert knowledge suggests will never be violated.

Figure 11:
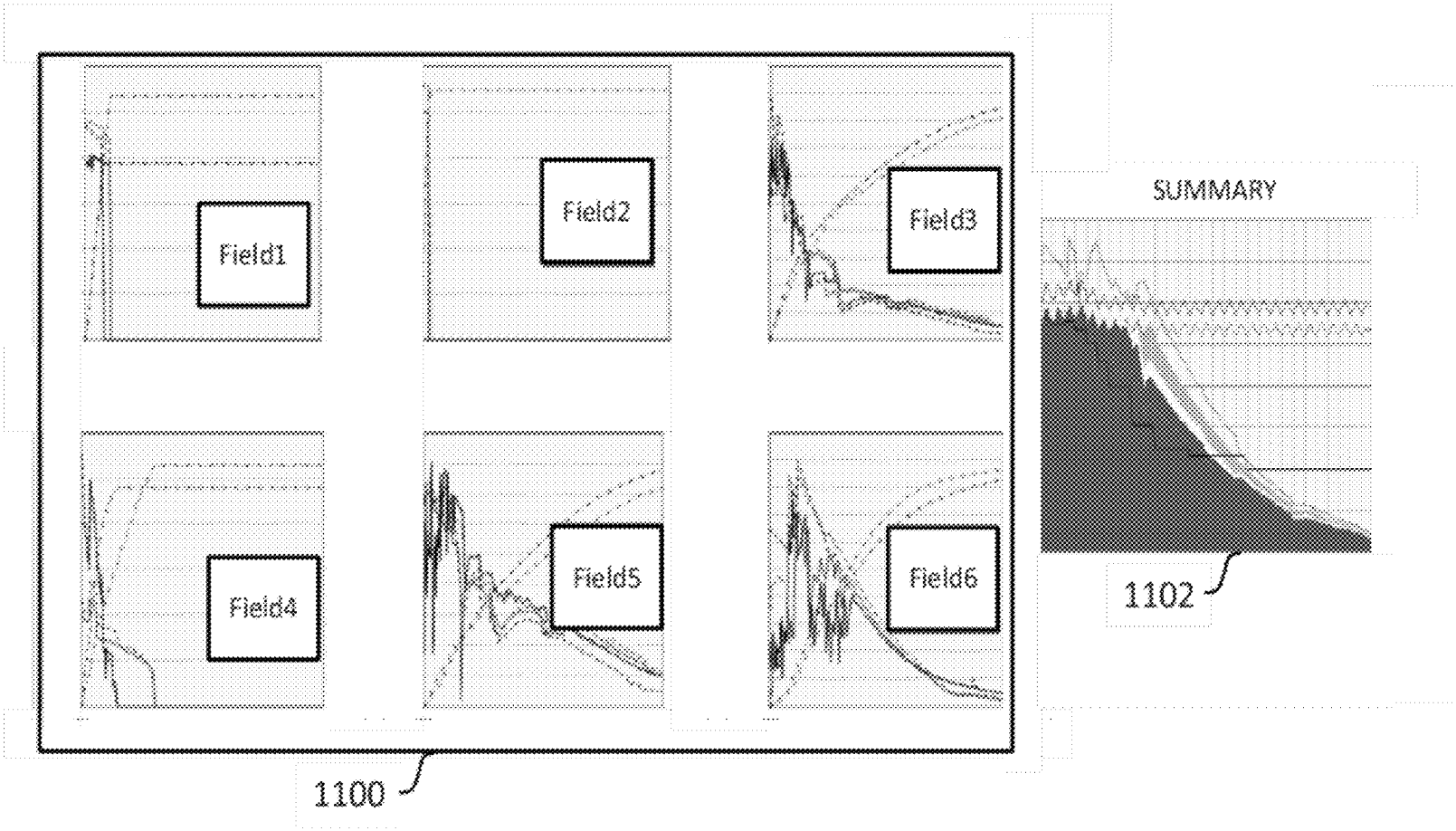
FIG. 11 illustrates standardized displays of production forecasting for communication and quality assurance purposes.

Method 100 of FIG. 1 continues to step 13, forecasting hydrocarbon production. This may be done, for example, using the IPM suite of PETEX. The present embodiment displays the input data, intermediate products and final hydrocarbon production forecasting results in a standardised manner. This facilitates the quality assurance process and enhances communication across the multiple stakeholders. Given the individual needs of each user company, it is unlikely that any forecasting software can provide the customized visualisation plots for the diverse end users of the software. The IPM suite is not an exception. However, the IPM suite offers a link to external software via OpenServer. OpenServer has the capability to interface with Excel, different reservoir simulation software, process simulators and general reporting packages. The present embodiment uses a dashboard that extracts all the IPM input and forecast data into an Excel spreadsheet underpinned by object-oriented VBA code. The dashboard automatically creates a range of customized plots both for communication and quality assurance purposes. FIG. 11 shows sample plots in the dashboard. The displays may show various production curves for multiple fields 1100 as well as summary production for the entire integrated production model 1102.

Figure 12:
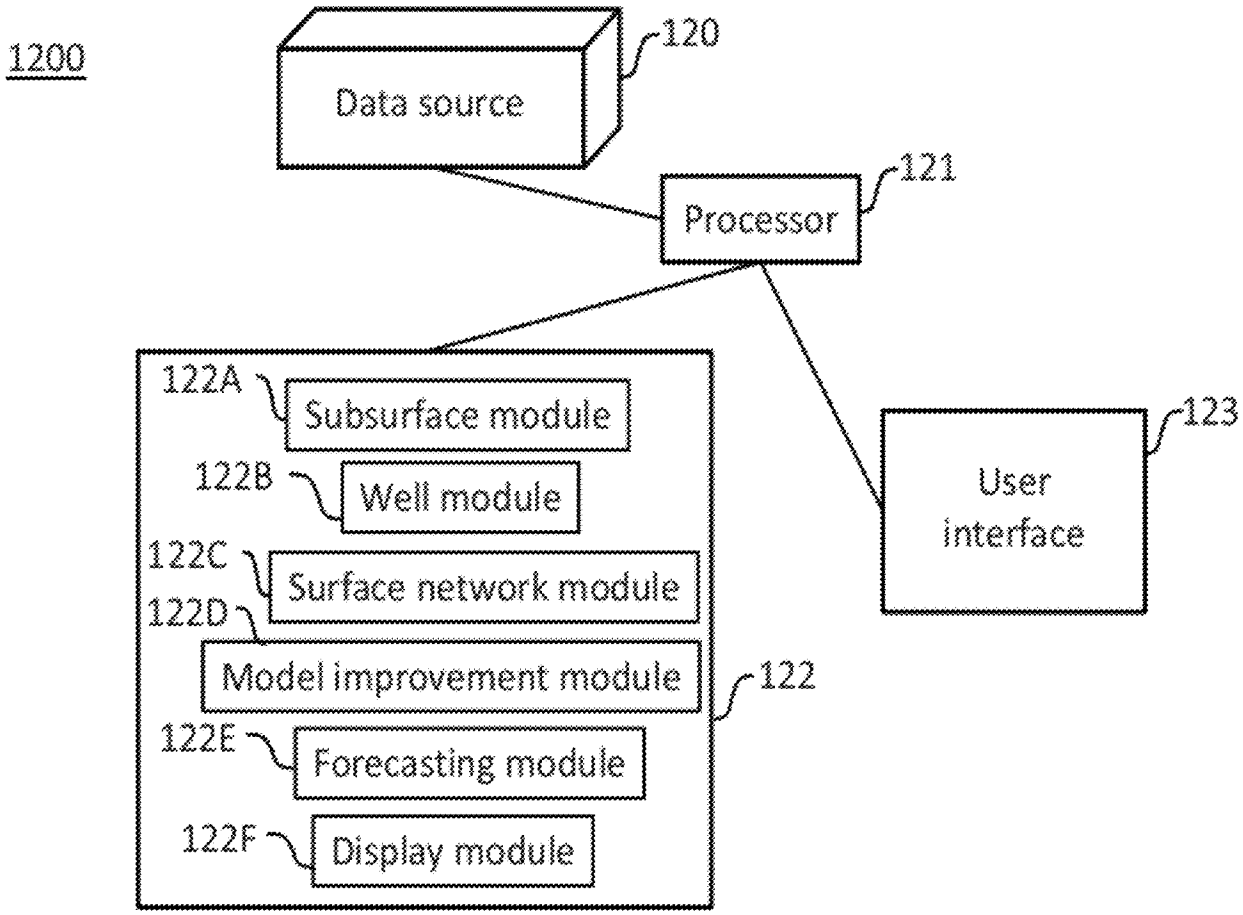
FIG. 12 schematically illustrates a system for performing a method in accordance with an embodiment of the invention.

A system 1200 for performing the method is schematically illustrated in FIG. 12. The system includes a data source/storage device 120 which may include, among others, a data storage device or computer memory. The device 120 may contain, for example, production data from one or more fields and/or an initial integrated production model. The data from device 120 may be made available to a processorl21, such as a programmable general purpose computer. The processor 121 is configured to execute computer executable code 122 that can perform the method 100 of FIG. 1. These modules may include a subsurface module for parameterizing the subsurface, a well module for parameterizing the wells, a surface network module for parameterizing the surface network, a model improvement module for combining the newly parameterized subsurface, wells, and surface network into an improved integrated production model, a forecasting module for using the improved IPM to forecast hydrocarbon production, and a display module for preparing displays of input, output and intermediary products of the method. The system may include interface components such as user interface 123, and is used to implement the above-described transforms in accordance with embodiments of the invention. The user interface 123 may be used both to display data and processed data products and to allow the user to select among options for implementing aspects of the method.

While in the foregoing specification this invention has been described in relation to certain preferred embodiments thereof, and many details have been set forth for purpose of illustration, it will be apparent to those skilled in the art that the invention is susceptible to alteration and that certain other details described herein can vary considerably without departing from the basic principles of the invention. In addition, it should be appreciated that structural features or method steps shown or described in any one embodiment herein can be used in other embodiments as well.

What is claimed is:

1. A computer-implemented method for improved hydrocarbon production forecasting, the method comprising:

a. obtaining, at a computer processor, an initial integrated production model representative of at least two interconnected subsurface tanks, at least one well, and a surface network, wherein the surface network comprises multiple components including at least one pipeline;

b. parameterizing, via the computer processor, a subsurface part of the integrated production model by using material balance to characterize the at least two interconnected subsurface tanks;

c. parameterizing, via the computer processor, a well part of the integrated production model based in part on well geometry;

d. parameterizing, via the computer processor, the surface network based on the multiple components of the surface network;

e. combining, via the computer processor, the parameterized subsurface part, the parameterized well part and the parameterized surface network into a reduced-constraint integrated production model wherein the combining comprises removing redundant constraints from at least the parameterized subsurface part or the parameterized well part or the parameterized surface network; and f. forecasting, via the computer processor, hydrocarbon production based on the reduced-constraint integrated production model.

2. The method of claim 1 wherein the multiple components of the surface network include a fixed pressure separator and at least one other separator.

3. The method of claim 2 wherein the at least one other separator is an inline separator.

4. The method of claim 2 wherein the fixed pressure separator and the at least one other separator are constrained to produce at a streamday demand rate.

5. The method of claim 1 wherein the multiple components of the surface network include at least one compressor.

6. The method of claim 5 wherein a speed of the at least one compressor is optimized as part of the parameterizing the surface network.

7. The method of claim 1 wherein the multiple components of the surface network include at least one separator and at least one compressor.

8. The method of claim 1 further comprising a second subsurface part of the integrated production model that is parameterized separately from the subsurface part, a second well part that is parameterized separately from the well part, and wherein the surface network includes components connected to both the well part and the second well part.

9. The method of claim 1 wherein the parameterizing the surface network includes a downtime factor that represents planned downtime, unplanned downtime, and weather-related downtime.

10. The method of claim 1 wherein the parameterizing the surface network includes calibrating the surface network using daily production data.

11. The method of claim 1 wherein the parameterizing the subsurface part uses a transmissibility factor between the at least two interconnected subsurface tanks to improve reservoir tank pressure history matching.

12. The method of claim 1 wherein the parameterizing the well part uses water production history matching.

13. The method of claim 1 wherein the well geometry is vertical, deviated, horizontal or big bore wells.

14. The method of claim 1 further comprising repeating steps b-f when changes occur to at least one of the material balance, the well geometry, and the multiple components of the surface network.

15. The method of claim 14 wherein the changes include removing one or more components of at least one of the subsurface part, the well part and the surface network.

16. The method of claim 14 wherein the changes include replacing one or more components of at least one of the subsurface part, the well part and the surface network.

17. The method of claim 14 wherein the changes include adding one or more components of at least one of the subsurface part, the well part and the surface network.

18. A system for improved hydrocarbon production forecasting, the system comprising:

a. a data storage device containing an integrated production model and well production data;

b. a user-interface device; and c. a computer processor in communication with the data storage device and the user-interface device, the computer processor being designed to receive user input from the user-interface device, to provide visual displays of initial data, intermediate results and final results to the user-interface device, and to execute computer-executable modules, the computer-executable modules comprising:

i. a subsurface module for parameterizing a subsurface part of the integrated production model by using material balance to characterize the at least two subsurface tanks;

ii. a well module for parameterizing a well part of the integrated production model based in part on well geometry;

iii. a surface network module for parameterizing the surface network based on the multiple components of the surface network;

iv. a model improvement module for combining the parameterized subsurface part, the parameterized well part and the parameterized surface network into a reduced-constraint integrated production model model wherein the combining comprises removing redundant constraints from at least the parameterized subsurface part or the parameterized well part of the parameterized surface network;

v. a forecasting module for forecasting hydrocarbon production based on the improved integrated production model; and vi. a display module for preparing displays of the initial data, the intermediate results and the final results.

* * * * *